US005667258A

United States Patent [19]

Takimoto

[11] Patent Number: 5,667,258

[45] Date of Patent: Sep. 16, 1997

[54] LATCH ASSEMBLY

[75] Inventor: Kazuhide Takimoto, Tokyo, Japan

[73] Assignee: Takigen Manufacturing Co. Ltd., Tokyo, Japan

[21] Appl. No.: 500,342

[22] Filed: Jul. 10, 1995

[30] Foreign Application Priority Data

Oct. 24, 1994 [JP] Japan ..... 6-284359

[51] Int. Cl.[6] ..... E05C 5/00

[52] U.S. Cl. ..... 292/113; 292/DIG. 49; 292/247; 292/66

[58] Field of Search ..... 292/113, DIG. 49, 292/63–66, 247

[56] References Cited

U.S. PATENT DOCUMENTS

| | | | |
|---|---|---|---|
| 3,008,320 | 11/1961 | Cheney | 292/113 X |
| 3,936,082 | 2/1976 | Swanson | 292/113 |
| 4,218,081 | 8/1980 | Johnson | 292/66 |
| 4,243,255 | 1/1981 | Hornak | 292/113 |
| 5,452,926 | 9/1995 | Takimoto | 292/113 |
| 5,462,318 | 10/1995 | Cooke | 292/200 |

FOREIGN PATENT DOCUMENTS 61-176375 1/1986 Japan .

*Primary Examiner*—Steven N. Meyers
*Assistant Examiner*—Donald J. Lecher
*Attorney, Agent, or Firm*—Martin Smolowitz

[57] ABSTRACT

A latch assembly is provided. In the assembly: base-end portions of an operating lever 3 are connected to bearing-plate portions 2 of a base plate 1 through a first pivot 4; base-end portions of a latch arm 5 are connected to intermediate portions of the operating lever 3 through a second pivot 6; and extension-plate portions 12 of a lock plate 11, which are mounted in slots 13 of guide-plate portions 10 of the base plate 1 in insertion manner, are engaged with locking notches 21 of locking-plate portions 20 of a socket plate 19 fixed to the operating lever 3 and slidably urged by a compression coil spring 18 so as to be held in such engagement, whereby the operating lever 3 is locked to the base plate 1.

2 Claims, 6 Drawing Sheets

LATCH ASSEMBLY

BACKGROUND OF THE INVENTION

1. Field of the Invention

The present invention relates to a latch assembly used in an instrument box and the like.

2. Description of the Prior Art

In a conventional latch assembly disclosed in Japanese Utility Model Laid-Open No. Sho 61-176375 (1988): a base-end portion of an operating lever is connected to a bearing-plate portion of a base plate through a first pivot, the bearing-plate portion is projecting from an end portion of the base plate; a base-end portion of a latch arm is connected to an intermediate portion of the operating lever through a second pivot; and, in a latch locking condition in which a front-end hook portion of the latch arm engages with an engaging-end portion of a catch member, both the first pivot and the second pivot are so arranged as to have the second pivot disposed between a predetermined straight line and the base plate, the predetermined straight line passing through the engaging-end portion of the catch member and the first pivot.

In this conventional latch assembly, since the assembly is not provided with any means for locking the operating lever to the base plate, there is a fear that: a front-end portion of the operating lever is hit by any other articles so that the operating lever is rotated on the first pivot to have the latch arm disengaged from the catch member by accident, whereby a wing element having been locked to a stationary frame of a body part is unlocked by accident.

Further, in this conventional assembly, there is not provided any mechanism for adjusting in position a latch arm relative to a catch member of the wing element. Consequently, the catch member and the body part, which are improperly assembled, often make it impossible to lock the wing element to the body part.

SUMMARY OF THE INVENTION

Consequently, it is an object of the present invention to provide a latch assembly, which prevents any accidental unlocking operations of the assembly even when a front-end portion of an operating lever is hit by any other articles, and ensures a proper locking operation of the assembly even when the catch member is not properly assembled relative to the body part.

The above object of the present invention is accomplished by providing:

a latch assembly characterized in that:

a base-end portion of an operating lever is connected to a bearing-plate portion of a base plate through a first pivot, the bearing-plate portion projecting from an end portion of the base plate;

a base-end portion of a latch arm is connected to an intermediate portion of the operating lever through a second pivot;

in a latch locking condition in which a front-end hook portion of the latch arm engages with an engaging-end portion of a catch member, both the first pivot and the second pivot are so arranged as to have the second pivot disposed between a predetermined straight line and the base plate, the predetermined straight line passing through the engaging-end portion of the catch member and the first pivot;

a guide-plate portion, which projects from the other end of the base plate, is received in a rear-surface side concave portion of the operating lever, and provided with a slot for slidably receiving an extension-plate portion of a lock plate therein, the slot extending in a longitudinal direction of the base plate;

a base-end portion of a push plate fixed to the lock plate is disposed in the vicinity of a finger-engaging end portion of the operating lever;

a first spring-support plate portion of a front-end portion of the push plate is slidably received in a through-hole of a spring-support plate projecting from an intermediate portion of the base plate;

a first coil spring, which is mounted on the first spring-support plate portion in an insertion manner, is compressed between an end surface of the lock plate and the spring-support plate to slidably urge the push plate in a manner such that the extension-plate portion of the lock plate abuts on a far one surface of opposite inner wall surfaces of the slot, the far one being more distant from the first pivot relative to the other of the opposite inner wall surfaces;

a socket plate is fixedly mounted on the operating lever and provided with a locking-plate portion projecting into the rear-surface side concave portion of the operating lever, the locking-plate portion being provided with a locking notch in its side-edge portion to have the locking notch engaged with and disengaged from the extension-plate portion of the lock plate;

an oblique cam surface portion adjacent to the locking notch is provided in a front-end portion of the locking-plate portion so as to have the oblique cam surface brought into a slidable contact with an edge surface of the extension-plate portion of the lock plate, so that the lock plate is slidably moved in the slot toward the other surface of the opposite inner wall surfaces of the slot;

a third spring-support plate portion is provided in an end portion of the socket plate in the vicinity of the first pivot to extend perpendicularly to a second spring-support plate portion of the end portion of the socket plate toward the second pivot, the third spring-support plate portion being slidably mounted in a through-hole of a spring-support member in an insertion manner, the spring-support member being adjacent to the second pivot to assume a substantially U-shaped form in its longitudinal section; and a second coil spring is mounted on the third spring-support plate portion of the socket plate in an insertion manner and compressed between the second spring-support plate portion and the spring-support member to slidably urge the spring-support member in a manner such that the second pivot abuts on a far one. Surface of opposite inner wall surfaces of an elongated pivot hole, the far one surface being more distant from the first pivot relative to the other surface of the opposite inner wall surfaces.

DESCRIPTION OF THE PREFERRED EMBODIMENTS

Figure 1:
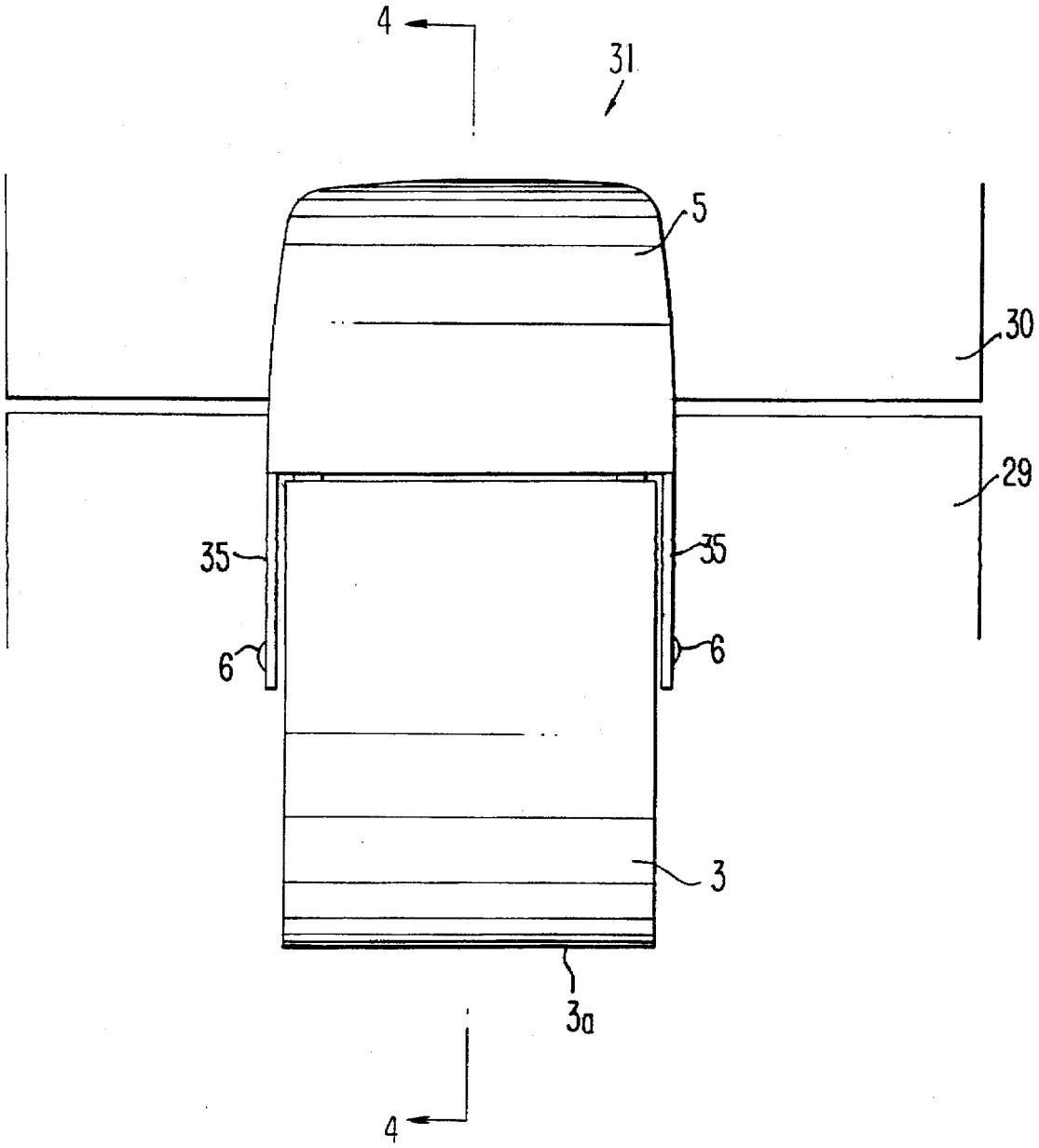
FIG. 1 is a front view of an embodiment of the latch assembly of the present invention, illustrating its locking condition.

Hereinbelow, the present invention will be described in detail with reference to the accompanying drawings and the reference numerals and characters therein.

Figure 2:
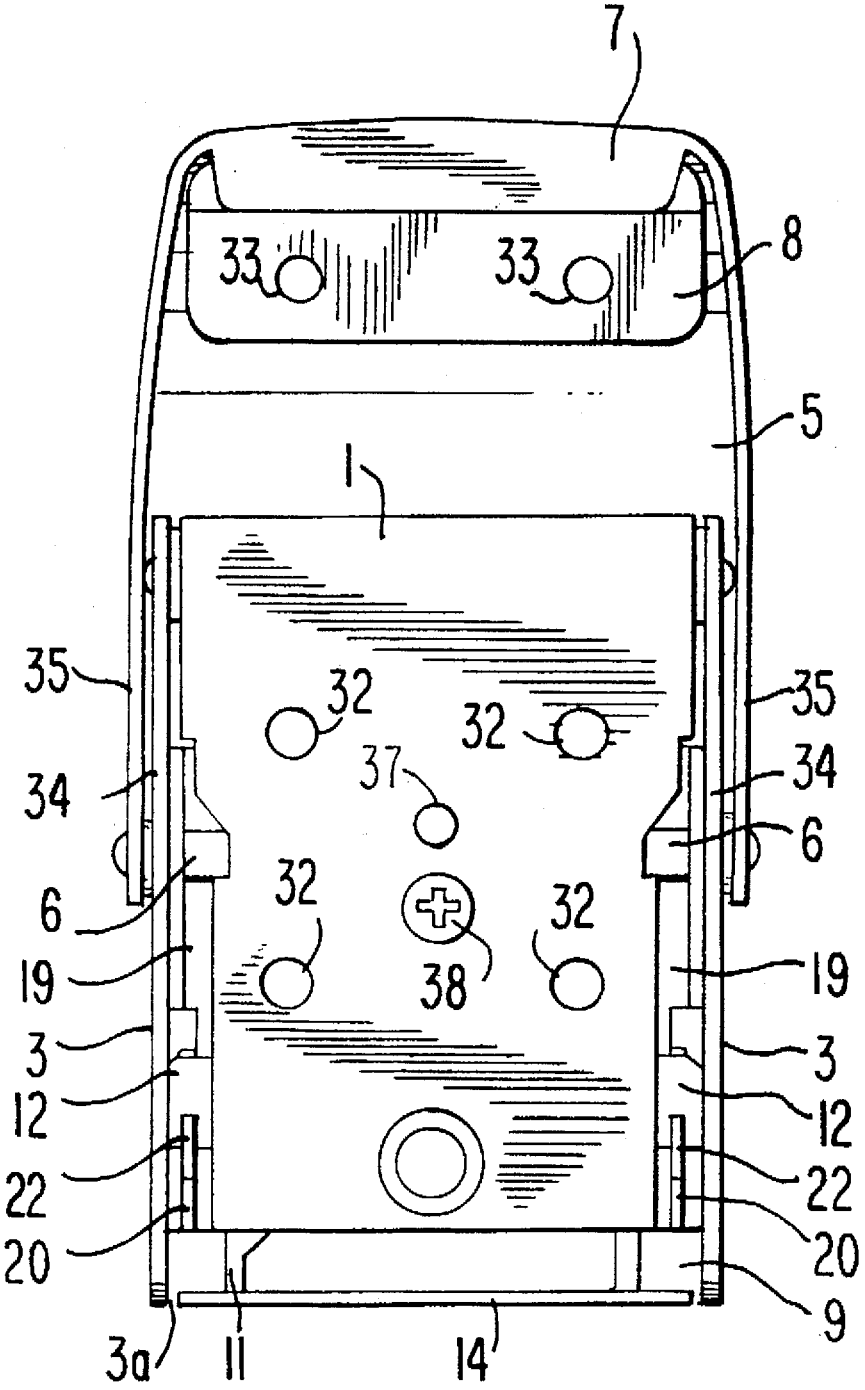
FIG. 2 is a rear view of the latch assembly of the present invention shown in FIG. 1.
Figure 3:
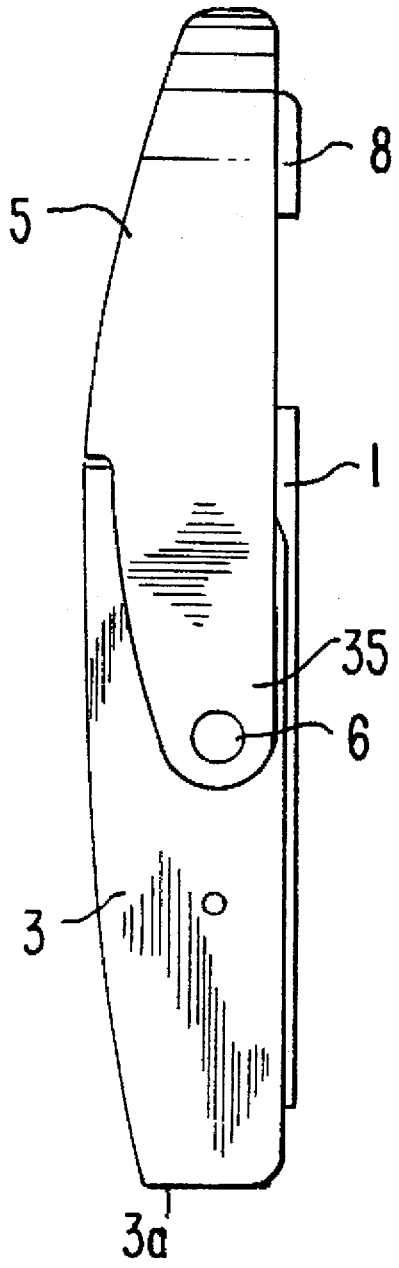
FIG. 3 is a right side view of the latch assembly of the present invention shown in FIG. 1.
Figure 4:
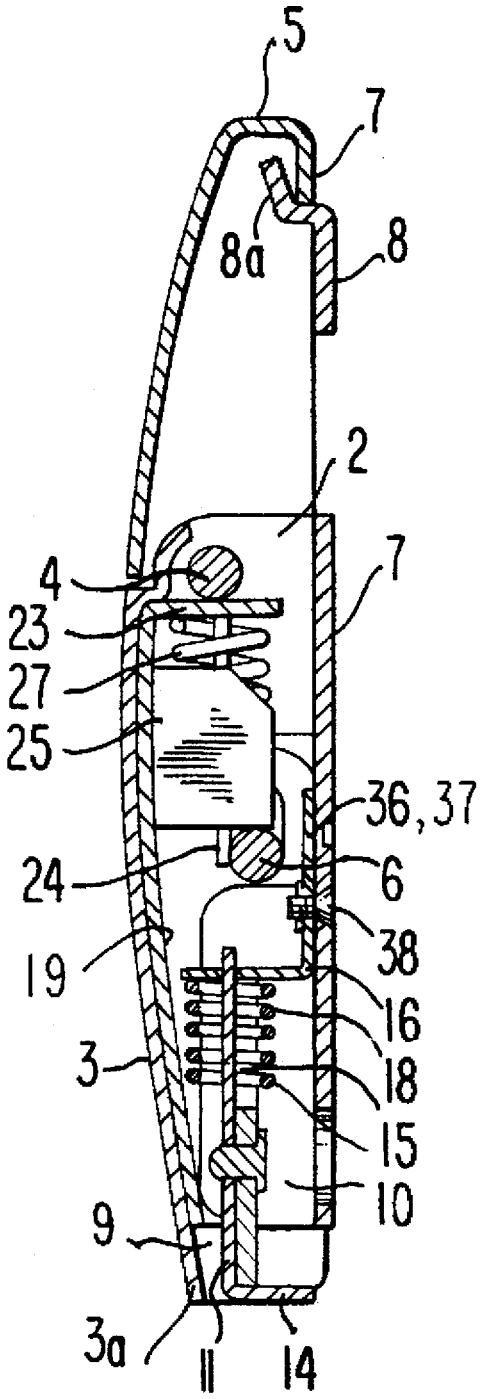
FIG. 4 is a longitudinal sectional side view of the latch assembly of the present invention, taken along the line 4—4 of FIG. 1.
Figure 5:
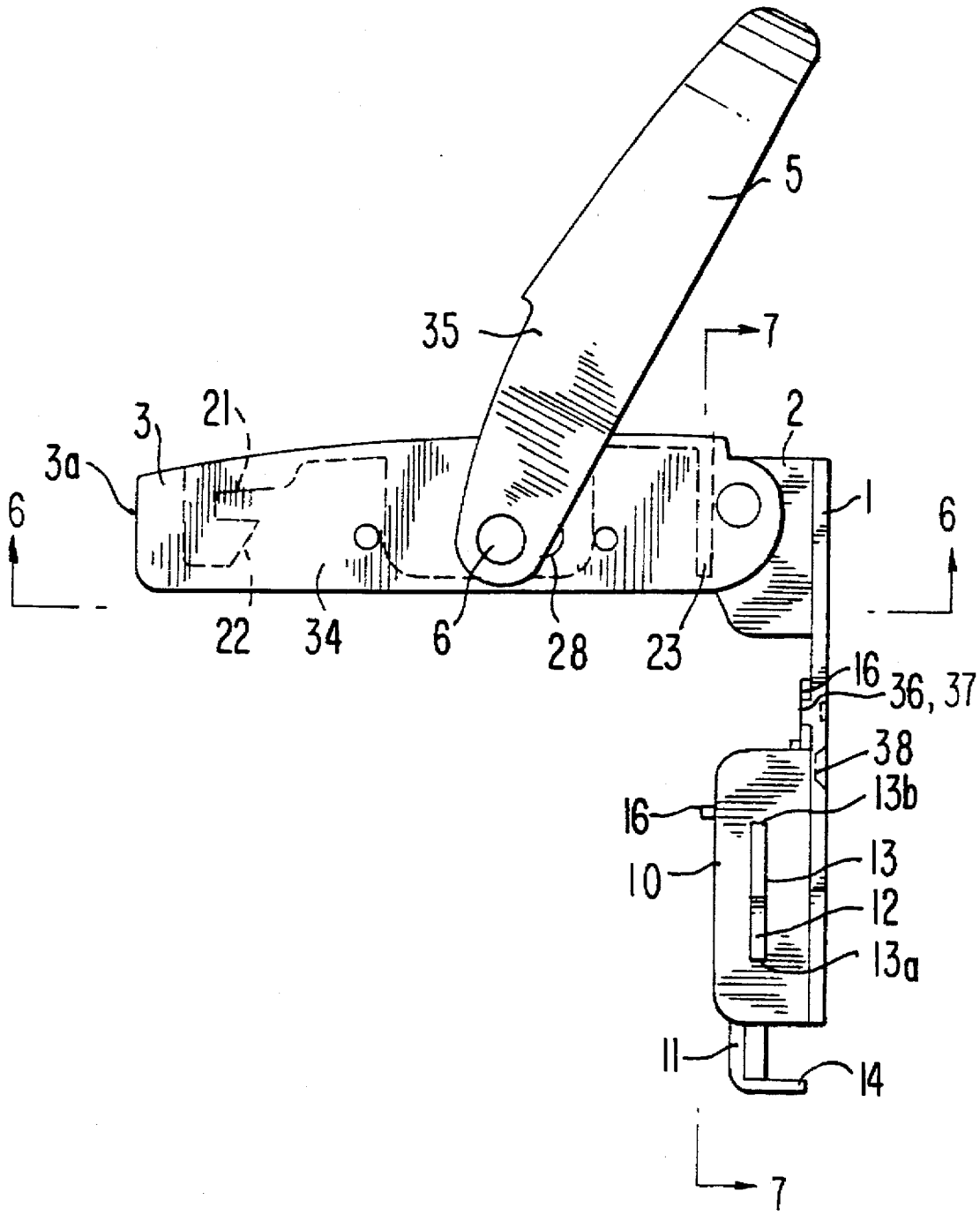
FIG. 5 is a right side view of the latch assembly of the present invention shown in FIG. 1, illustrating its unlocking condition.
Figure 6:
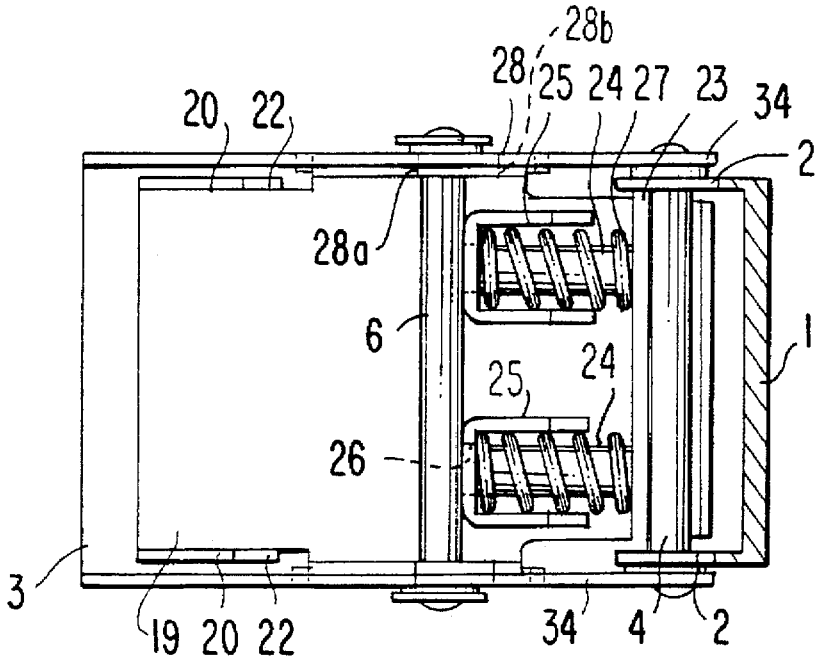
FIG. 6 is a partially sectional view of the latch assembly of the present invention, taken along the line 6—6 of FIG. 5.

In a latch assembly of the present invention, as shown in FIG. 6, a pair of base-end portions of an operating lever 3 are connected to a pair of bearing-plate portions 2 of a base plate 1 through a first pivot 4. Each of the bearing-plate portions 2 projects from each of opposite end portions of the base plate 1. As is clear from FIGS. 2 and 5, a pair of base-end portions of a latch arm 9 are connected to a pair of intermediate portions of the operating lever 3 through a second pivot 6. As shown in FIG. 4, in a latch locking condition in which a front-end hook portion 7 of the latch arm 5 engages with an engaging-end portion 8*a* of a catch member 8, both the first pivot 4 and the second pivot 6 are so arranged as to have the second pivot 6 disposed between a predetermined straight line and the base plate 1, the predetermined straight line passing through the engaging-end portion 8*a* of the catch member 8 and the first pivot 4.

Figure 7:
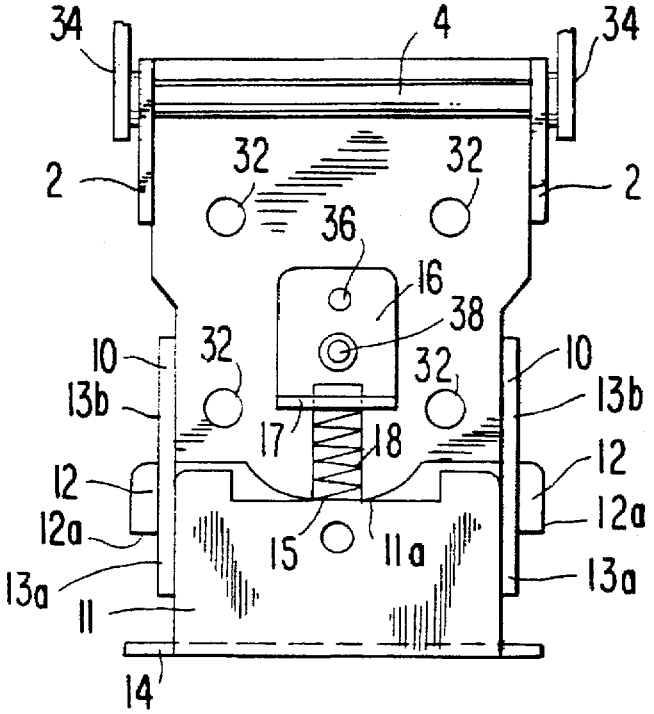
FIG. 7 is a view of the latch assembly of the present invention, taken along the line 7—7 of FIG. 5.

On the other hand, as shown in FIGS. 5 and 7, each of a pair of guide-plate portions 10, which projects from the other end of the base plate 1, is received in a rear-surface side concave portion 9 of the operating lever 3, and provided with a slot 13 for slidably receiving each of a pair of extension-plate portions 12 of a lock plate 11 therein. The slot 13 extends in a longitudinal direction of the base plate 1. A base-end portion of a push plate 14 fixed to the lock plate 11 is disposed in the vicinity of a finger-engaging end portion 3*a* of the operating lever 3. A first spring-support plate portion 15 of a front-end portion of the push plate 14 is slidably received in a through-hole 17 of a spring-support plate 16 projecting from an intermediate portion of the base plate 1. A first coil spring 18, which is mounted on the first spring-support plate portion 15 in an insertion manner, is compressed between an end surface 11*a* of the lock plate 11 and the spring-support plate 16 to slidably urge the push plate 14 in a manner such that each of the extension-plate portions 12 of the lock plate 11 abuts on a far one surface 13*a* of opposite inner wall surfaces 13*a*, 13*b* of each of the slots 13. The far one surface 13*a* is more distant from the first pivot 4 relative to the other surface 13*b*.

A socket plate 19 is fixedly mounted on the operating lever 3 and provided with a pair of locking-plate portions 20 projecting into the rear-surface side concave portion 9 of the operating lever 3. Each of the locking-plate portions 20 is provided with a locking notch 21 in its side-edge portion so as to have the locking notch 21 engaged with and disengaged from each of the extension-plate portions 12 of the lock plate 11. An oblique cam surface portion 22 adjacent to each of the locking notches 21 is provided in a front-end portion of each of the locking-plate portions 20 to have the oblique cam surface 22 brought into a slidable contact with an edge surface 12*a* of each of the extension-plate portions 12 of the lock plate 11, so that the lock plate 11 is slidably moved in each of the slots 13 toward the other surface 13*b* of the opposite inner wall surfaces 13*a*, 13*b* of each of the slots 13.

A pair of third spring-support plate portions 24 are provided in an end portion of the socket plate 19 in the vicinity of the first pivot 4 to extend perpendicularly to a second spring-support plate portion 23 of the end portion of the socket plate 19 toward the second pivot 6. Each of the third spring-support plate portions 24 is slidably mounted in a through-hole 26 of each of a pair of spring-support members 25 in an insertion manner. Each of the spring-support members 25 is adjacent to the second pivot 6 and assumes a substantially U-shaped form in its longitudinal section with its rearward end in contact with the second pivot 6. Each of a pair of second coil springs 27 is mounted on each of the third spring-support plate portions 24 of the socket plate 19 in an insertion manner and compressed between the second spring-support plate portion 23 and each of the spring-support members 25 to slidably urge each of the spring-support members 25 in a manner such that the second pivot 6 abuts on a far one surface 28*a* of opposite inner wall surfaces 28*a*, 28*b* of each of a pair of elongated pivot holes 28. The far one surface 28*a* is more distant from the first pivot 4 relative to the other surface 28*b* of the opposite inner wall surfaces 28*a*, 28*b*.

For example, the base plate 1 is fixedly mounted on a stationary frame 29, while the catch member 8 is fixedly mounted on a wing element 30. In a condition in which the wing element 30 is closed and latch-locked to the stationary frame 29, the operating lever 3 flattens on the base plate 1 so that the second pivot 6 is disposed between: the predetermined straight line passing through both the engaging-end portion 8*a* of the catch member and the first pivot 4; and, the base plate 1, as shown in FIG. 4. At this time, the guide-plate portions 10 of the base plate 1 are housed in the rear-surface side concave portion 9 of the operating lever 3, so that each of the locking-plate portions 20 of the socket plate 19 fixed to the operating lever 3 is oppositely disposed from an outer side of each of the guide-plate portions 10.

On the other hand, each of the extension-plate portions 12 of the lock plate 11 slidably received in the slots 13 of the guide-plate portions 10 engages with each of the locking notches 21 of the locking-plate portions 20 of the socket plate 19. Since each of the extension-plate portions 12 is slidably urged by the coil spring 18 toward the distant one surface 13*a* of the inner wall surfaces 13*a*, 13*b* of each of the slots 13 relative to the first pivot 4, the locking notches 21 are firmly engaged with the extension-plate portions 12 to keep their firm engagement therewith in a stable manner so that the operating lever 3 is latch-locked to the base plate 1, whereby the wing element 30 is locked to the stationary frame 29 to keep its locking condition.

A simple push or depression of the push plate 14 with a finger of a user is enough to unlock and release the wing element 30. Through such a simple push or depression, the push plate 14 integral with the lock plate 11 moves along the slots 13 of the guide plate 10 toward the first pivot 4. When the extension-plate portions 12 of the lock plate 11 slidably move to the other-side inner wall surfaces 13*b* of the slots 13 by a predetermined distance, these extension-plate portions 12 are disengaged from the locking notches 21 of the locking-plate portions 20 of the socket plate 19 so that the operating lever 3 is unlocked relative to the base plate 1.

Under such circumstances, the user picks up the finger-engaging end portion 3*a* of the operating lever 3 with his finger to rotate the lever 3 on the first pivot 4 in a condition in which the push plate 14 is held in its depressed position. The push plate 14 is released from its depressed position when the operating lever 3 is rotated to reach its predetermined angular position, in which there is no fear that the locking notches 21 engage with the extension-plate portions 12. As a result, the lock plate 11 automatically returns to its initial position under the influence of a resilient force exerted by the first coil spring 18, in which initial position the extension-plate portions 12 abut on the inner wall surfaces 13*a* of the slots 13.

When the operating lever 3 is further picked up to further rotate relative to the base plate 1, the second pivot 6 is moved toward a front end of the base plate 1, so that the latch arm 9 is rotated on the second pivot 6 to have its front-end hook portion 7 disengaged from the engaging-end portion 8*a* of the catch member 8, whereby the wing element 30 is unlocked and released from the stationary frame 29, which permits the user to open the wing element 30 by pulling the operating lever 3 or any other handle means provided in the wing element 30.

After completion of desired operations, the wing element 30 is closed again and the operating lever 3 is swingably pushed down so as to rotate on the first pivot 4. As a result, the front-end hook portion 7 of the latch arm 5 is brought into a slidable contact with a front-side plate portion 31 of the wing element 30 and moved to the engaging-end portion 8*a* of the catch member 8. After that, when the second pivot 6 reaches a position between: the predetermined straight line passing through the engaging-end portion 8*a* of the catch member 8 and the first pivot 4; and, the base plate 1, the front-end hook portion 7 of the latch arm 5 is firmly engaged with the engaging-end portion 8*a* of the catch member 8 so that the wing element 30 is latch-locked to the stationary frame 29.

In the final stage of downward rotation of the operating lever 3, each of the oblique cam surfaces 22 of the locking-plate portion 20 are brought into a slidable contact with each of the edge surfaces 12*a* of the expansion-plate portions 12 of the lock plate 11, so that the lock plate 11 is slidably moved to the inner wall surfaces 13*b* of the slots 13, the inner wall surfaces 13*b* being disposed in the vicinity of the first pivot 4. When such downward rotation of the operating lever 3 is completed, each of the extension-plate portions 12 of the lock plate 11 is oppositely disposed from each of open ends of the locking notches 21 of the locking-plate portions 20 of the socket plate 19. At this time, the extension-plate portions 12 of the lock plate 11 are automatically engaged with the engaging notches 21 of the socket plate 19 under the influence of the resilient force exerted by the coil spring 18, so that the operating lever 3 is locked to the base plate 1 again.

Even in case that the catch member 8, which is fixedly mounted on the wing element 30, is disposed in a position slightly separated from the base plate 1 fixedly mounted on the stationary frame 29, the coil springs 27 mounted on the spring-support plate portions 24 in an insertion manner are compressed between the spring-support plate portions 24 and the spring-support members 25 to slidably urge the spring-support members 25 in a manner such that the second pivot 6 abuts on the distant one surface 28*a* of the inner wall surfaces 28*a*, 28*b* of the elongated pivot holes 28 of the operating lever 3 relative to the first pivot 4. Consequently, in locking operation, the second pivot 6 is slidably urged to abut on the other ones 28*b* of the inner wall surfaces 28*a*, 28*b* of the elongated pivot hole 28 by the action of the coil springs 27, so that the wing element 30 is brought into a close contact with the stationary frame 29. As shown in the FIGS. 2 and 7 drawings, the base plate 1 is fixedly mounted on the wing element 30 by four screws or like fasteners passing through four mounting holes 32 of the plate 1. On the other hand, the catch member 8 is provided with a pair of mounting holes 33 and fixedly mounted on the stationary frame 29 by a pair of screws and or like fasteners passing through the mounting holes 33 thereof. The bearing-plate portions 2 of the base plate 1 form a pair of projections. The first pivot 4, which forms a cross pivot, is mounted in a pair of base-end portions of the opposite side-wall plate portions 34 of the operating lever 3 in an insertion manner. The second pivot 6, which forms another cross pivot, is mounted in an insertion manner in both: the intermediate portions of the opposite side-wall plate portions 34 of the operating lever 3; and, the left-end portions of the opposite side-wall plate portions 35 of the latch arm 5.

The lock plate 11 may be integrally formed with the push plate 14. However, in the embodiment of the present invention shown in the drawings, they are separately formed, and then spot-welded together and further fastened together by using suitable fasteners such as rivets and the like. The spring-support plate 16 may be formed as a bent portion of the base plate 1. However, in the embodiment of the present invention shown in the drawings, the spring-support plate 16 and the base plate 1 are separately formed. In assembling, the spring-support plate 16 has its positioning hole 37 fitted to a positioning projection 36 of the base plate 1, and is then fixedly mounted to the base plate 1 by fastening a screw 38.

The socket plate 19 may be integrally formed with the operating lever 3. However, in the embodiment of the present invention shown in the drawings, they are separately formed and spot-welded together. The push plate 14 has its portion bent rearward to form a wide finger-engaging plate portion 14*a*. The spring-support member 25, which assumes a substantially U-shaped form in cross section, is provided with the through-hole 26 in a wall portion of its base-end portion, in which through-hole 26 each of the spring-support plate portions 24 of the socket plate 19 is slidably mounted in an insertion manner. The second pivot 6 abuts on the wall portion of the base-end portion of each of the spring-support members 25.

In the latch assembly of the present invention having the above construction: the base-end portions of an operating lever 3 are connected to the bearing-plate portions 2 of a base plate 1 through the first pivot 4; the base-end portions of the latch arm 5 are connected to the intermediate portions of the operating lever 3 through the second pivot 6; and, the extension-plate portions 12 of the lock plate 11, which are mounted in the slots 13 of the guide-plate portions 10 of the base plate 1 in an insertion manner, are engaged with the locking notches 21 of the locking-plate portions 20 of the socket plate 19 fixed to the operating lever 3 and slidably urged by the first compression coil spring 18 so as to be held in such engagement, whereby the operating lever 3 is locked to the base plate 1. Since the push plate 14, which forms a means for disengaging the lock plate 11 from the socket plate 19, is so arranged as to be housed in the rear-side concave portion 9 of the operating lever 3, there is no fear that the operating lever 3 is hit and picked up into rotation (i.e., unlocking operation thereof) by any other articles by accident.

Further, even in case that the catch member 8 fixed to the wing element 30 is disposed in a position slightly separated from the the base plate 1 fixed to the stationary frame 29: since the second coil springs 27 mounted on the spring-support plate portions 24 in an insertion manner are compressed between the spring-support plate portions 24 and the spring-support members 25 to slidably urge the spring-support members 25 in a manner such that the second pivot 6 abuts on the distant ones 28*a* of the inner wall surfaces 28*a*, 28*b* of the elongated pivot holes 28 of the operating lever 3 relative to the first pivot 4, it is possible for the second pivot 6 to be slidably urged in locking operation so as to abut on the other ones 28*b* of the inner wall surfaces 28*a*, 28*b* of the elongated pivot hole 28 by the action of the coil springs 27, so that the wing element 30 is brought into a close contact with the stationary frame 29.

What is claimed is:

1. A latch assembly, comprising:

a base-end portion of an operating lever (3) connected to a bearing-plate portion (2) of a base plate (1) through a first pivot (4), said bearing-plate portion (2) projecting from an end portion of said base plate (1);

a base-end portion of a latch arm (5) connected to an intermediate portion of said operating lever (3) through a second pivot (6);

in a latch locking condition in which a from-end hook portion (7) of said latch arm (5) engages with an engaging-end portion (8*a*) of a catch member (8), both said first pivot (4) and said second pivot (6) are so arranged as to have said second pivot (6) disposed between a predetermined straight line and said base plate (1), said predetermined straight line passing through said engaging-end portion (8*a*) of said catch member (8) and said first pivot (4);

a guide-plate portion (10), which projects upwardly from the other end of said base plate (1), is received in a rear-surface side concave portion (9) of said operating lever (3), and provided with a slot (13) for slidably receiving an extension-plate portion (12) of a lock plate (11) therein, said slot (13) extending in a longitudinal direction of said base plate (1);

a base-end portion of a push plate (14) fixed to said lock plate (11) is disposed in the vicinity of a finger-engaging end portion (3*a*) of said operating lever (3);

a first spring-support plate portion (15) of a front-end portion of said push plate (14) is slidably received in a through-hole (17) of a spring-support plate (16) projecting upwardly from an intermediate portion of said base plate (1);

a first coil spring (18), which is mounted on said first spring-support plate portion (15) in an insertion manner, is compressed between an end surface (11*a*) of said lock plate (11) and said spring-support plate (16) to slidably urge said push plate (14) in a manner such that said extension-plate portion (12) of said lock plate (11) abuts on a far one surface (13*a*) of opposite inner wall surfaces (13*a*, 13*b*) of said slot (13), said far one surface (13*a*) being more distant from said first pivot (4) relative to the other surface (13*b*);

a socket plate (19) is fixedly mounted on said operating lever (3) and provided with a locking-plate portion (20) projecting downwardly into said rear-surface side concave portion (9) of said operating lever (3), said locking-plate portion (20) being provided with a locking notch (21) in its side-edge portion to have said locking notch (21) engaged with and disengaged from said extension plate portion (12) of said lock plate (11) in a latch locking condition;

an oblique cam surface portion (22) adjacent to said locking notch (21) is provided in a front-end portion of said locking-plate portion (20) so as to have said oblique cam surface (22) brought into a slidable contact with an edge surface (12*a*) of said extension-plate portion (12) of said lock plate (11) so that said lock plate (11) is slidably moved in said slot (13) toward said other surface (13*b*) of said opposite inner wall surfaces (13*a*, 13*b*) of said slot (13);

a third spring-support plate portion (24) is provided in an end portion of said socket plate (19) in the vicinity of said first pivot (4) to extend perpendicularly to a second spring-support plate portion (23) of said end portion of said socket plate (19) toward said second pivot (6), said third spring-support plate portion (24) being slidably mounted in a through-hole (26) of a spring-support member (25) in an insertion manner, said spring-support member (25) adjacent to said second pivot (6) to assume a substantially U-shaped form in its longitudinal section with its rearward end in contact with the second pivot (6); and a second coil spring (27) is mounted on said third spring-support plate portion (24) of said socket plate (19) in an insertion manner and compressed between said second spring-support plate portion (23) and said spring-support member (25) to slidably urge said spring-support member (25) in a manner such that said second pivot (6) abuts on a far one surface (28*a*) of opposite inner wall surfaces (28*a*, 28*b*) of an elongated pivot hole (28), said far one surface (28*a*) being more distance from said first pivot (4) relative to the other surface (28*b*) of said opposite inner wall surfaces (28*a*, 28*b*); whereby said front end hook portion (7) of said latch arm (5) can be engaged with said engaging end portion (8*a*) of said catch member (8) and latched to said base plate (1) by rotating said operating lever (3) about said first pivot (4) so as to engage said extension plate portion (12) in said locking notch (21) of said locking plate portion (20).

2. A latch assembly according to claim 1, wherein said base plate (1) is fixedly mounted onto a stationary frame (29) and said catch member (8) is fixedly-mounted onto a wing element (30).

* * * * *